US006780148B2

(12) United States Patent
Ohinata et al.

(10) Patent No.: US 6,780,148 B2
(45) Date of Patent: Aug. 24, 2004

(54) DECANTER TYPE CENTRIFUGAL SEPARATOR WITH RESTRICTION EFFECTED DISCHARGE ROUTE

(75) Inventors: Tetsuo Ohinata, Tokyo (JP); Hiroyoshi Mizukami, Tokyo (JP); Noboru Suzuki, Tokyo (JP); Yasuyuki Yoshida, Osaka (JP); Hiroyuki Matsui, Osaka (JP); Takashi Uchikawa, Osaka (JP)

(73) Assignees: Kotobuki Engineering & Manufacturing Co., Ltd., Hiroshima (JP); Kubota Corporation, Osaka (JP)

( * ) Notice: Subject to any disclaimer, the term of this patent is extended or adjusted under 35 U.S.C. 154(b) by 0 days.

(21) Appl. No.: 10/182,709

(22) PCT Filed: Jan. 31, 2001

(86) PCT No.: PCT/JP01/00670

§ 371 (c)(1),
(2), (4) Date: Aug. 8, 2002

(87) PCT Pub. No.: WO01/58596

PCT Pub. Date: Aug. 16, 2001

(65) Prior Publication Data

US 2003/0013591 A1 Jan. 16, 2003

(30) Foreign Application Priority Data

Feb. 10, 2000 (JP) ..... 2000-032896

(51) Int. Cl.[7] ..... B04B 1/20
(52) U.S. Cl. ..... 494/53
(58) Field of Search ..... 494/37, 50–56, 494/67

(56) References Cited

U.S. PATENT DOCUMENTS

| | | | | |
|---|---|---|---|---|
| 1,806,241 A | | 5/1931 | Dupuis | |
| 3,096,282 A | | 7/1963 | Trotter, Jr. | |
| 3,098,820 A | | 7/1963 | Gooch | |
| 5,261,869 A | | 11/1993 | Caldwell et al. | |
| 5,685,819 A | * | 11/1997 | Nishida et al. | 494/53 |
| 5,695,442 A | * | 12/1997 | Leung et al. | 494/37 |
| 2003/0013591 A1 | * | 1/2003 | Ohinata et al. | 494/53 |

FOREIGN PATENT DOCUMENTS

| | | | |
|---|---|---|---|
| DE | 1 209 956 | | 1/1966 |
| DE | 3620912 A1 | * | 12/1987 |
| JP | 36-3447 | | 4/1961 |
| JP | 51-150776 | | 12/1976 |
| JP | 57-156055 | | 9/1982 |
| JP | 58-156359 | | 9/1983 |
| JP | 62-45363 | | 2/1987 |
| JP | 9-57152 | * | 3/1997 |
| JP | 9-57153 | | 3/1997 |
| JP | 2000-237630 | | 9/2000 |
| JP | 2001-219097 | * | 8/2001 |

(List continued on next page.)

*Primary Examiner*—Charles E. Cooley
(74) *Attorney, Agent, or Firm*—Westerman, Hattori, Daniels & Adrian, LLP

(57) ABSTRACT

A decanter type centrifugal separator capable of discharging sludge directly from a portion of the sludge with least moisture content in a bowl so as to lower a moisture content and increase a separation efficiency, wherein a screw conveyor rotated with a difference in speed provided relative to the bowl is stored in the bowl rotated at a high speed, a dewatering cake discharge route (20) is provided in one end wall (2) of the bowl, an opening (20*a*) of the route into the bowl is provided near the inner peripheral wall of the bowl, the discharge route provides a restriction effect to the discharge of the dewatering cake, and a sedimentary layer with thick sedimentation layer is formed near the opening, whereby that portion only of the cake is discharged through the discharge route under head press of the sedimentation layer, that portion receiving the highest consolidation effect by the head press of a centrifugal force acting on the sediment, among the sedimentation layers accumulated at one end of the bowl.

8 Claims, 5 Drawing Sheets

FOREIGN PATENT DOCUMENTS

| | | | |
|---|---|---|---|
| JP | 2002-153771 | * | 5/2002 |
| JP | 2002-153772 | * | 5/2002 |
| JP | 2002-153773 | * | 5/2002 |
| JP | 2002-239415 | * | 8/2002 |
| JP | 2002-239416 | * | 8/2002 |
| JP | 2002-273269 | * | 9/2002 |
| JP | 2002-282737 | * | 10/2002 |
| JP | 2003-135996 | * | 5/2003 |
| WO | 01/58596 A1 | * | 8/2001 |

* cited by examiner

DECANTER TYPE CENTRIFUGAL SEPARATOR WITH RESTRICTION EFFECTED DISCHARGE ROUTE

TECHNICAL FIELD

This invention relates to a centrifugal separator for concentrating, dewatering, as well as for recovering heavy sedimentation components and separated water from sewage sludge, industrial wastewater, and several products in chemical and food industries by centrifugal force.

BACKGROUND ART

In solid/liquid separation of sludge, decanter type centrifugal separators have generally been used in the past. As indicated in FIG. 7, this separator is comprised of a bowl 1, (outer rotating cylinder) that is formed by connecting a cone 31, at the tip of a horizontally elongated straight drum section 30, and in which an inner cylinder 11 (inner rotating cylinder) is equipped with a spiral blade 12 and a screw conveyor 10 is provided to rotate at a relative speed difference with respect to the bowl 1, so that sludge processing liquid, a, is fed into bowl 1 from inner cylinder 11 to achieve solid/liquid separation by centrifugal force. Dewatered cake b, which is a heavy component separated by the sedimentation process, is scraped toward the front end of the bowl by spiral blade 12, receives further compaction and dewatering treatments in cone 31 before it is discharged out of the separator from sludge discharge holes 7, provided at the front end of the separator. The separated liquid c is discharged through the overflow process out of the separator through a discharge opening 32, provided at a rear end wall 3 of bowl 1 which is located at the opposite side. (Hereafter in this description the direction in which the centrifugal force is exerted, or the direction along which the bowl radius increases, is referred to as the "down" direction; while the direction along which the bowl radius decreases is referred to the "up" direction)

This decanter type centrifugal separator, which stores filtered liquid in bowl 1, is characterized by a feature requiring that the cone 31 whose front end is squeezed to a small diameter up to the same level (water level) of the discharge hole 32 for the separated liquid, in order to prevent filtered liquid from being discharged through the sludge discharge hole 7 that is designed to discharge the cake, and in order to improve the dewatering effect by elevating the dewatered cake above the water level in the bowl by a cone section, called the "beach".

Although conventional centrifugal separators have been developed to concentrate or dewater crystals in the liquid phase, if the same separators are applied for the concentration or dewatering of processing items such as sludge, which has different characteristics from the former, it is necessary to provide a strong compaction effect in order to squeeze water out so that the dewatering efficiency can be improved, because the sedimentation layer of the sludge is pasty and is strongly hydrophilic. In the conventional decanter type centrifugal separators mentioned, the processing liquid, a, supplied to the center section of bowl 1 undergoes solid/liquid separation under the strong centrifugal force field (approximately 2,000 to 3,0000G) in the straight drum section 30 immediately after being supplied. Yet, in cone section 31 where the dewatered cake b is discharged, the centrifugal force is weak resulting in an increase in the moisture content, because its distance from the center of rotation (radius) is short. In fact, in the system depicted in FIG. 7, it has been observed that the moisture content becomes minimum in the d section, which is around the boundary between the straight drum section and the cone section. Moreover, it is necessary to elevate the cone section against the strong centrifugal force in order for the sedimentation layer to be discharged. Even if an attempt is made to move the sedimentation layer by the screw conveyor, the so-called co-rotation phenomenon due to friction resistance occurs when the moisture content is low, resulting in the cake becoming stagnant and unable to be discharged. Conversely, there is a tendency that only the cake having relatively high moisture content near the center of rotation of straight drum section 30 can be discharged.

Also since the dewatered cake b passes through a cone having a long slope in order to be discharged over the water level in the bowl, there is a disadvantage in that a slip is produced at this section impairing the discharge process, resulting in sludge being discharged together with separated liquid through a separated liquid discharge opening 32, and contaminating the separated liquid. In addition, since the dewatered cake to be discharged has a relatively high moisture content in the vicinity of the rotational center of straight drum section 31, in order to decrease the moisture content of the cake to be discharged, the current practice is to increase the rotational speed of bowl 1 beyond what is actually needed (approximately at 2,000 to 3,000 rpm), which requires a large amount of power.

In order to discharge the pasty sedimentation layer, which is difficult to transport by a screw conveyor, an operating condition called the "negative dam" or the "upside overflow" is used, in which the discharge opening position of the separated liquid is higher than the discharge opening of the sedimentation layer. One of such systems, for example, is the Ambler type system (U.S. Pat. No. 3,172,851, and Japanese Patent Application Kokai H6-190302), which uses the head press of the processing liquid in the bowl to assist in the discharge of the sedimentation layer.

Nevertheless, since the liquid level in the bowl is high, the sedimentation layer is still below the liquid surface even in the "beach" section, there has been a problem in that the moisture content increases since the "beach" having a low head press due to the centrifugal force is elevated as it is. (A strong centrifugal force is applied in the bowl, and some layer in the bowl receives a strong pressure due to the centrifugal force applied to the liquid layer or the sedimentation layer above. In this description, this pressure is called the head press.)

In addition, for the Lee type centrifugal separator, a separation plate having a slight gap with the bowl wall is provided in the vicinity of the boundary between the straight drum section and the cone section. An attempt is made to extract only the bottom sections of the sedimentation layer through this gap between the bowl wall and the separation plate.

Yet, as mentioned above, it is difficult to transport the pasty sedimentation layer having low moisture content by the screw conveyor. Since the usable head press is limited to the water level in the bowl, a special construction including a scraping-up device (Japanese Patent Application Kokai H4-59065) is needed for discharging such a layer.

One of these types is designed to supply the processing liquid through a rotating shaft of the bowl so that the separated liquid and sedimentation layer can be discharged through the rotating shaft (Japanese Patent Publication S63-31261). Although this system has an outstanding performance as a separator, there are cases in which difficulties have been encountered in discharging a dewatered cake having low moisture content.

All centrifugal separators mentioned above have their sedimentation layer discharge opening at essentially the same or higher level than the liquid level in the bowl. Even when the head press in the bowl is used for discharge, the head press of the processing liquid in the bowl is lower than the head press of the heavy solid layer; thus it is theoretically impossible to discharge the heavy solid layer only by the head press, thus it requires some type of discharging mechanism.

DISCLOSURE OF INVENTION

This invention is to solve the problems mentioned above for the decanter type centrifugal separator, in order for the conventional centrifugal separator to be able to achieve direct discharge of the sludge from the d section in which the moisture content is the lowest. With this invention, the separation process is expedited and its efficiency is improved, while the bowl speed reduction is realized leading to power saving, and simplification and size reduction of the system are realized since the cone shaped "beach" section is no longer necessary.

In the centrifugal separator according to this invention, comprised of a rotating bowl with a high rotational speed and a screw conveyor that is provided within the bowl and rotates with a relative speed difference therewith, a discharge route for the dewatered cake is provided at one end wall of the bowl, and the opening of this discharge route into the bowl is provided in the vicinity of the inner perimeter wall of the bowl (herein, "bowl" means the section in which the processing liquid undergoes the solid/liquid separation process by centrifugal force.)

With this design, as far as the discharged cake from the discharge route is concerned, only its section having the highest compaction effect due to the head press of the centrifugal force being applied to the sediment in the sedimentation layer that was deposited at one end of the bowl can be discharged through the discharge route.

When the processing liquid is supplied to the bowl during the starting period of the centrifugal separator, it is not desirable to have the solid component be discharged immediately through the discharge hole without being concentrated and dewatered. In order for the solid component to achieve good sedimentation (to achieve a high transparency in the separated liquid), it is necessary that the solid component be subjected to centrifugal force in the bowl for a specified time period. It is, therefore, advantageous to have the liquid discharge route constructed in such a manner that the initial liquid level in the bowl can be maintained at least during the initial starting period.

Of course, during the operation, the separator may assume a condition called the downside overflow system in which the discharge opening for the separated liquid is lower than the discharge opening for the dewatered cake, or conversely it may assume a condition called an upside overflow system in which the discharge opening for the separated liquid is higher than the discharge opening for the dewatered cake. In the case of the upside overflow, the water level in the bowl, which is dependent on the height of the discharge opening for the separated liquid, is maintained by the sedimentation layer deposited along the side of the discharge route.

The discharge route mentioned above acts as a restriction that limits the quantity of the dewatered cake discharged from the sedimentation layer. In the centrifugal separator according to this invention, the dewatered cake in the discharge route is mainly pushed out by the head press resulting from the centrifugal force of the sedimentation layer that acts on the backside surface, the transport force of the screw, and in some cases by the supply pressure of the processing liquid to the bowl.

Since the discharge quantity is dependent on the discharge resistance exerted by the discharge route, and on the pressure pushing the dewatered cake out, the compaction effect on the dewatered cake as well as the discharge quantity are small when the thickness of the heavy component deposit layer deposited in the vicinity of the discharge route opening is small. Consequently, the thickness of the deposit layer in the vicinity of the discharge route opening gradually increases with the accumulation of the heavy component sedimentation that is scraped by the screw conveyor. Yet, the increase in the thickness of the deposit layer causes the pushing force to increase, resulting in an increase in the discharge quantity that overcomes the discharge resistance. Thus, the thickness of the deposit layer is kept constant by a balance between the accumulation quantity and the discharging quantity.

Since the specific weight of the sedimentation layer is greater than that of the processing fluid, the head press that can be used for the discharge will be greater than the head press of the processing fluid that is used in the conventional system. Especially for the condition in which the sedimentation layer protrudes above the liquid level due to the restriction effect that limits the discharge quantity, its head press becomes very high making the dewatered cake discharge easier. Furthermore, the compaction effect on the dewatered cake by the deposit layer maximizes resulting in the low moisture content of the discharged solid component.

BEST MODE FOR CARRYING OUT THE INVENTION

Explained below using figures are the best aspects for embodying this invention.

Figure 1:
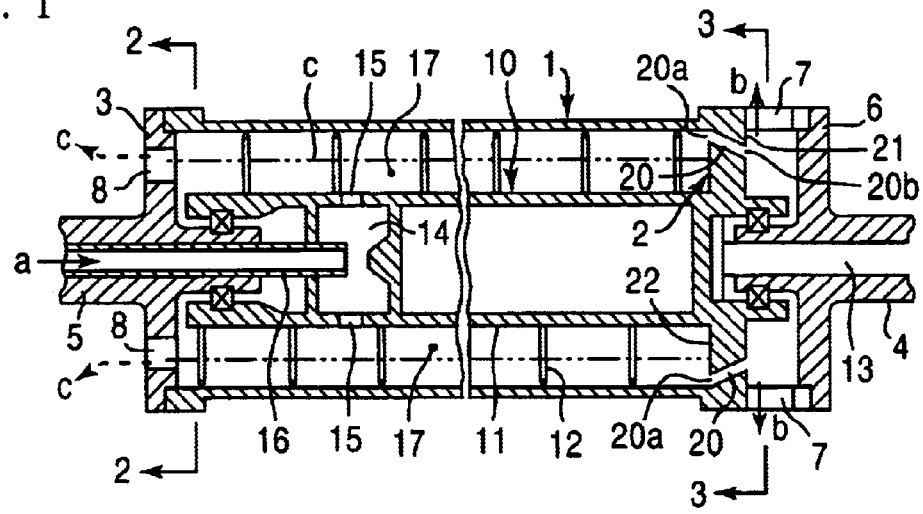
FIG. 1 is a side cross section indicating the construction of an embodiment of the centrifugal separator according to the present invention.
Figure 2:
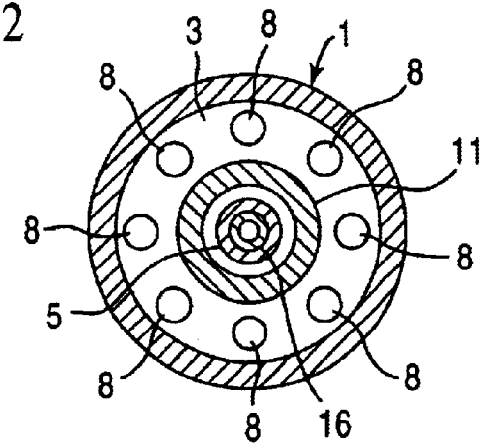
FIG. 2 is an 2—2 cross section of FIG. 1.
Figure 3:
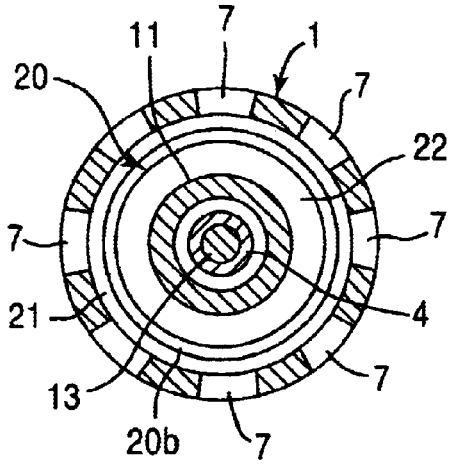
FIG. 3 is a 3—3 cross section of FIG. 1.
Figure 4:
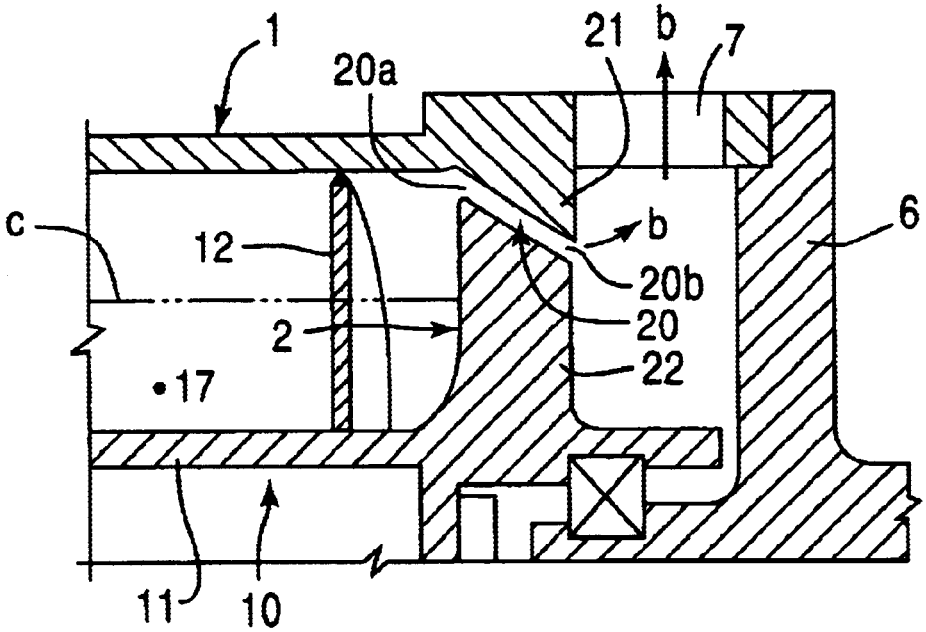
FIG. 4 is a partial cross section for the construction of the discharge route in the centrifugal separator according to an embodiment of the present invention.

FIG. 1 shows a side cross section of an embodiment of the separator according to this invention, while FIGS. 2 and 3 are 2—2 and 3—3 cross sections of the same, respectively. FIG. 4 is an enlarged view of major parts.

In FIGS. 1 to 4, symbol 1 represents a bowl (outer rotating cylinder) that rotates at a high speed and has a shape of a horizontal and cylindrical straight drum. Hollow shafts 4 and 5 are installed protruding from the center of the sludge discharge chamber wall 6 which is attached to the front end of bowl 1, and from the center of a rear end wall 3, respectively. These hollow shafts are supported by bearings, which are not shown in these figures, to be rotated at a high speed by a driver. A plurality of sludge discharge openings 7 are provided, at intervals along the circumferential direction, in the outer perimeter wall of the sludge chamber which is attached to the front end of bowl 1.

Although sludge discharge chamber wall 6 and sludge discharge openings 7 are configured integrally with the bowl in this embodiment, this configuration does not constitute the basic configuration of the centrifugal separator. Depending upon the need, appropriate design change may be made including a configuration in which they can be prepared detachable from bowl 1.

Discharge openings 8 for the separated liquid are provided in rear end wall 3 of bowl 1. These discharge openings 8 may be installed, for example, at intervals along the circumferential direction in a form of a plurality of fans, or as depicted in FIG. 2 in such a manner that a multiplicity of small holes is arranged at intervals in a concentric manner over rear end wall 3.

Symbol 10 represents a screw conveyor housed within bowl 1, in which a spiral wing (flight) 12 is wound over the outer circumference of a rotating drum 11 having a shape of a horizontal cylinder, the both ends of which are supported by the section of hollow shafts 4 and 5 of bowl 1 which protrude into the bowl in such a manner that the screw conveyor 10 is rotated by a rotating shaft 13 that is inserted through hollowed shaft 4 with a specified speed difference with respect to bowl 1. In addition, supply chamber 14 for processing liquid, a, is provided in rotating drum 11. A supply opening 15 that is connected to an annular space 17 between bowl 1 and rotating drum 11, is provided in the outer perimeter wall of rotating drum 11, while a supply pipe 16 for processing liquid, which is inserted from rear end hollow shaft 5 of bowl 1, is provided so that it opens to supply chamber 14.

A wall 2 is provided at the front end of annular space 17 of bowl 1, and a discharge route 20 for dewatered cake b is provided within wall 2. Referring to FIGS. 1 and 4, an opening section 20*a* of discharge route 20 into the bowl, is provided in contact with the inside surface of the perimeter wall of bowl 1. On the other hand, in the present embodiment, an opening section 20*b* constituting the discharge opening to the outside of bowl 1, has a height in the radial direction. Consequently, the sediment that can enter the discharge route from opening 20*a* can be limited only to that located at the lowest section of the deposit layer. On the other hand, opening 20*b* is designed so that the processing liquid is supplied during the initial phase of the operation to such an extent that it will not overflow opening 20*b*, thus determining the initial height of the liquid level in the bowl.

If this opening section 20*b* is too high, the centrifugal force applied to the dewatered cake within discharge route 20 cancels out the pushing force applied to the deposit layer in the bowl, resulting in a decrease in the discharging force for the dewatered cake. It is desirable, therefore, that the opening 20*b* should be as low as permissible.

On the other hand, discharge openings 8 for separated liquid determine the liquid level in annular space 17 during the operation. If the position of discharge openings 8 is lower than opening 20*b*, the operation assumes the so-called "downside overflow" condition; while if it is higher, the operation assumes the "upside overflow" condition. When the separator operates under the "upside overflow" condition, the processing liquid flowing from discharge route 20 is obstructed by the sedimentation layer accumulated in the vicinity of opening 20*a*.

In the extreme case, it is also possible to have the separated liquid discharged through the shaft center.

In the separator explained above, the processing liquid a undergoing the dewatering process enters feed chamber (feed zone) 14 from feed tube 16 as indicated by an arrow, is supplied to annular space 17 from feed opening 15, and is transported to the front end by spiral wing 12 while undergoing the solid/liquid separation by centrifugal force created by the rotation of bowl 1 and screw conveyor 10. Separated liquid c, which constitutes the separated liquid component, is discharged to the outside of the separator through discharge openings 8 located at the rear end wall.

On the other hand, the sedimentation layer is scraped together toward the front end of bowl 1 by spiral wing 12, while the remaining liquid is further separated by the separation operation of the centrifugal force. Separated liquid c by this process is also discharged outside through discharge openings 8.

A portion of the sedimentation layer that is transported to the front of bowl 1 will be accumulated at the front end of annular space 17, and this portion corresponds to the difference from the discharged quantity from discharge route 20. If the heavy component of the sediment is, for example, sand, the specific weight of this deposit layer is approximately 2.5 to 3, that is considerably heavier than 1 for water, resulting in the head press by the centrifugal force applied to this sedimentation layer becoming more than twice as high as that for water. Moreover, if the liquid level height determined by discharge openings 8 for separated liquid is lower than rotating drum 11, and if there is an air space between them, the deposit layer grows past the liquid surface. Depending upon the height of this growth and the magnitude of the specific weight, a large centrifugal head press is applied in the vicinity of opening 20*a* of the discharge route causing a great compaction effect on the deposit layer. The pushing operation to the discharge route is generated by this centrifugal head press and the screw transport force.

The centrifugal separator according to the present invention is not limited to the constructions mentioned above. A variety of design changes may be allowed within the scope of claims for this invention.

Figure 5:
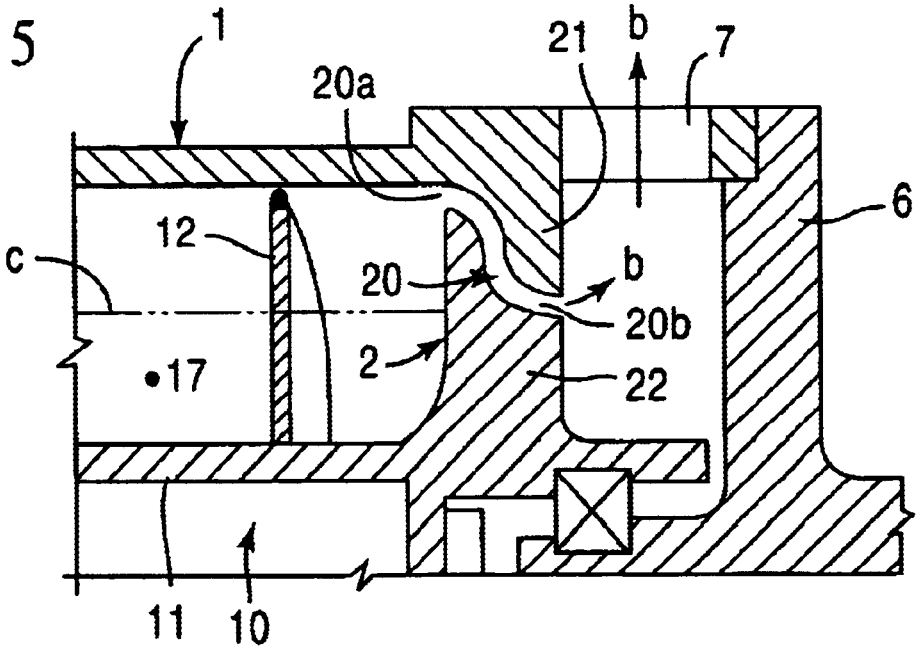
FIG. 5 is a partial cross section indicating another embodiment of the discharge route.

FIG. 5 shows an alternative embodiment of discharge route 20. In this embodiment, discharge route 20 does not have the cross section like the previous embodiment which forms a straight line sloping toward the end. Instead, its cross section includes a section that is almost parallel to wall 2 between openings 20*a* and 20*b*.

With the discharge route having this shape, even if the thickness of wall 2 is relatively small, it is possible to provide a necessary length (in other words, the discharge resistance) and appropriate difference in height between openings 20*a* and 20*b*.

Front end wall 2 of the annular space 17 mentioned above can be configured by two members that are installed with a slight gap between them in such a manner to form the discharge route 20 mentioned above. In other words, it can be configured by a member 21 protruding in the direction of rotating shaft from the vicinity of the inner wall of the bowl, and by a member 22 protruding from rotating drum 11 and extending while keeping an essentially same distance from the member 21 to form the discharge route between them.

Figure 6:
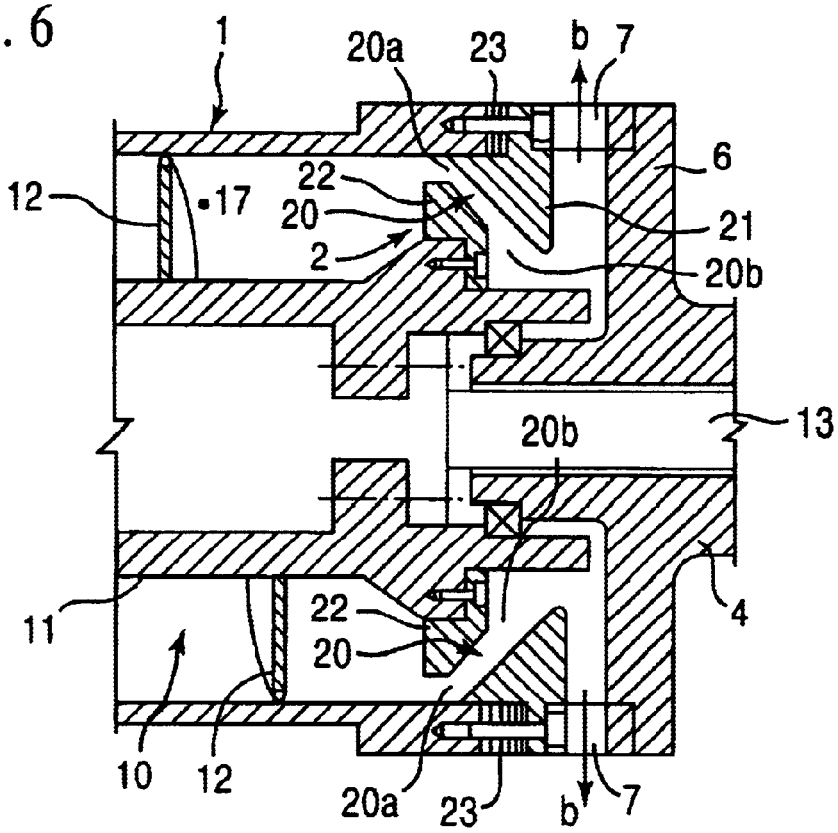
FIG. 6 is a partial cross section indicating another more embodiment of the discharge route.
Figure 7:
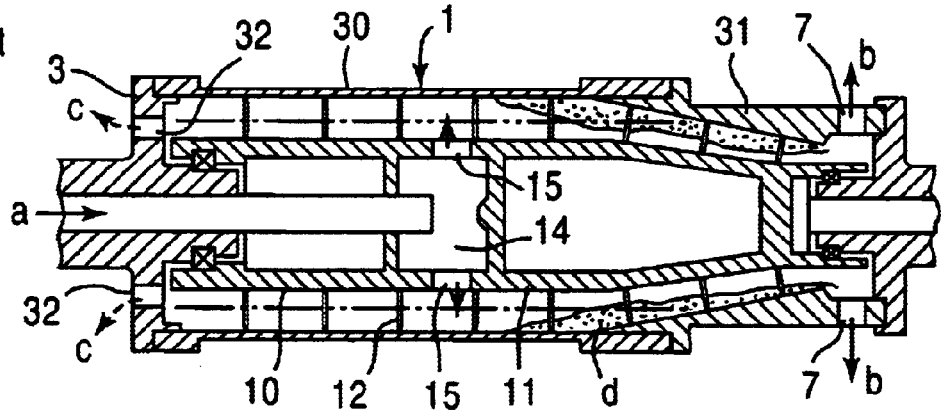
FIG. 7 Prior Art
FIG. 7 is a side cross section of a conventional decanter type centrifugal separator.

Another way may be that, as indicated in FIG. 6, discharge route 20 is formed by members which are separate from bowl 1 and rotating drum 11, and these members are fixed by bolts or other means. With this design, these members may be assembled with a spacer 23 interposed between them so that the size of the discharge route formed between them can be varied by choosing an appropriate spacer thickness. In FIG. 6, the upper half shows a narrow discharge route while the lower half shows a wide discharge route.

Although the discharge resistance can be made adjustable by varying the size of the discharge route, the height of the tip of member 22 from the inner wall of the bowl remains constant, so that the discharging section in the deposit layer remains unchanged.

It goes without saying that the adjustment of the gap between members 21 and 22 can be achieved by screws instead of the spacer, so that each member can be moved. With this type of discharge resistance adjustment, it is possible to adjust the discharge quantity as well as the moisture content.

Moreover, it is also possible to change the discharge section in the deposit layer by varying the height of member 22 if necessary.

Figure 8:
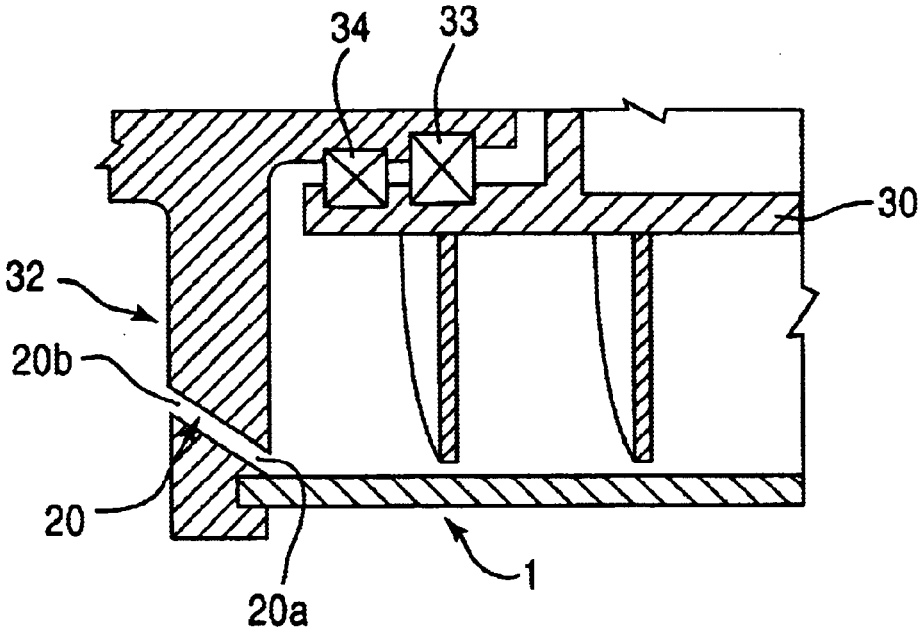
FIG. 8 shows a partial cross section showing an alternative embodiment of the bowl end.

In the embodiment mentioned above, wall 2 at the front end of the bowl where discharge route 20 for dewatered cake is provided is formed as an opposite part of the peripheral wall of the bowl and screw conveyor 10. In the alternative embodiment depicted in FIG. 8, a wall 32 at the front end of the bowl is a member that rotates as an integral part of bowl 1, and a screw conveyor 30 is sealed in bowl 1. When this type of construction is used, a high pressure seal 34 must be used for the seal in order to prevent the ingress of processing liquid into a bearing 33.

Figure 9:
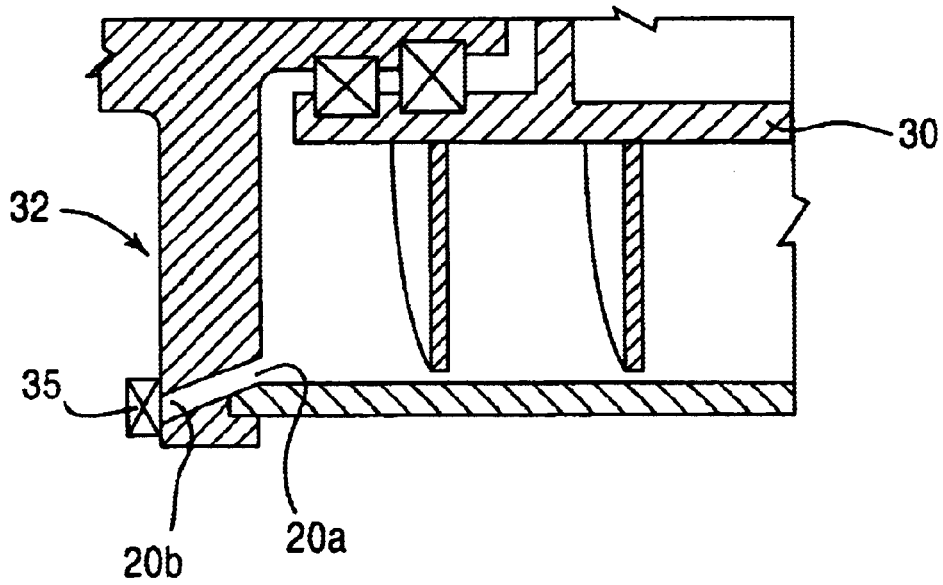
FIG. 9 is a partial cross section showing a further alternative embodiment of the discharge route.

In the embodiment mentioned above, opening 20*b* to the outside of the bowl is located higher than opening 20*a* to the inside of the bowl in order to prevent the processing liquid from flowing out directly through discharge route 20. Alternatively, it is also possible to locate opening 20*b* at the same or a higher position than opening 20*a* during the initial period of the operation, as indicated in FIG. 9, by a method, such as closing the discharge route by a valve, 35. This results in an easier discharge of the dewatered cake.

Figure 10:
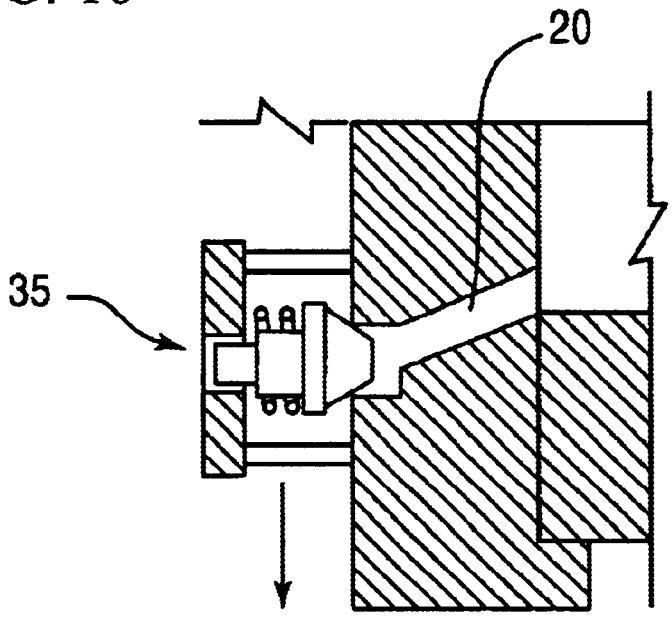
FIG. 10 is a partial cross section showing an embodiment of the valve provided at the discharge opening at the end of the discharge route.
Figure 11:
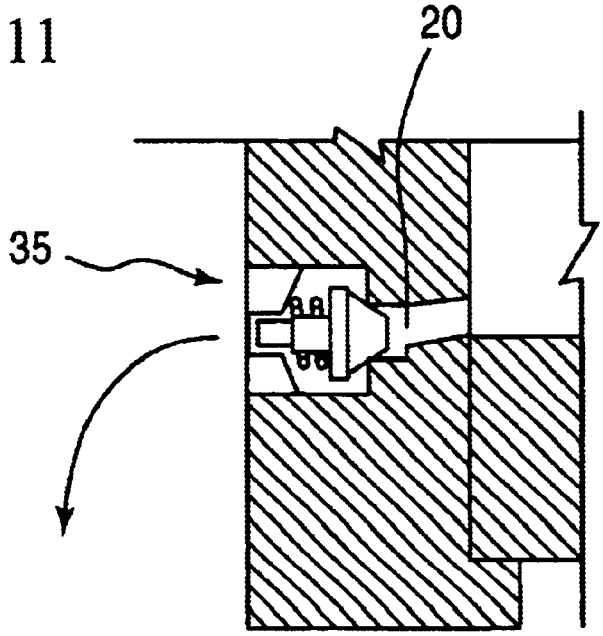
FIG. 11 is an alternative embodiment of the valve.

Valve 35 must not open under the centrifugal force resulting from the operation of the bowl, and must open only when the head press of the deposit layer increases. FIGS. 10 and 11 show a needle valve as one example of such a valve.

In the embodiments shown in FIGS. 8 through 11, discharge route 20 is provided as a plurality of holes arranged along the circumferential direction of the bowl wall.

INDUSTRIAL APPLICABILITY

As explained above, the centrifugal separator according to the present invention is based on a technological idea different from the common knowledge employed in conventional centrifugal separators. Since only the section having the highest compaction in the deposit layer of the sedimentation in the bowl is directly discharged in this invention, it is possible to decrease the moisture content of dewatered cake to an unprecedented level in comparison with conventional centrifugal separators.

Although in the conventional centrifugal separators, it has always been difficult to discharge the deposit layer having a low moisture content, in the centrifugal separator according to the present invention, it is possible to discharge such a layer without using special discharging means by taking advantage of a high head press generated through the formation of a high deposit layer by the discharge resistance in the discharge route.

With this design, it is possible to achieve a high dewatering rate and high separation efficiency, despite the fact that this system has a relatively simple construction and is relatively small in size.

What is claimed is:

1. A decantor type centrifugal separator which comprises a cylindrical bowl rotating in one direction and a screw conveyor that is housed in the bowl and is rotated coaxially with, in the same direction as, and with a difference in rotational speed to the bowl, and in which a heavy component is separated and sedimented by the centrifugal force from a processing liquid supplied to the interior of the rotating bowl, and accumulated on one side of the bowl by the screw conveyor, whereby the heavy component and separated liquid are separated and discharged, said centrifugal separator being characterized in that:

said bowl takes the form of a horizontal type cylindrical straight drum provided with a discharge route for the heavy component that has settled down in one end wall of the bowl, an opening of the discharge route to the inside of the bowl is provided in contact with an inner peripheral wall face of the bowl, said discharge route constitutes a choke passage to limit the discharge quantity, a sedimentary lever of the heavy component in a maximum state of compaction is formed in the vicinity of said opening by the discharge resistance of the choke passage, and only the maximum compaction state part of the heavy component sedimentary layer is discharged directly, mainly by the centrifugal head pressure which acts on the sedimentation and the pressing force of said screw conveyor.

2. The decantor type centrifugal separator according to claim 1 characterized in that, the discharge opening to the outside of the bowl for the accumulated heavy component from said discharge route is located at a radial position that is smaller than the radius of the bowl.

3. The decantor type centrifugal separator according to claim 1, characterized by comprising a first member extending in the direction of the rotating axis from the vicinity of the inner wall of the bowl, and a second member that extends keeping an essentially the same distance from said first member to form the discharge route with the first member.

4. The decantor type centrifugal separator according to claim 3, characterized in that, the member extending in the direction of the rotating axis from the vicinity of the inner wall of said bowl is a member having a conical inner surface, while the member that extends at a specified distance therefrom is a member having a conical outer surface.

5. The decantor type centrifugal separator according to claim 3, characterized in that, the member extending in the direction of the rotating axis from the vicinity of the inner wall of said bowl and the member extending at a specified distance therefrom are installed in the bowl in an interchangeable manner.

6. The decantor type centrifugal separator according to claim 5, characterized in that, the member extending in the direction of the rotating axis from the vicinity of the inner wall of said bowl is a member having a conical inner surface, while the member that extends at a specified distance therefrom is a member having a conical outer surface.

7. The decantor type centrifugal separator according to claim 3, characterized in that, at least one of either the member extending in the direction of the rotating axis from the vicinity of the inner wall of said bowl or the member extending at a specified distance therefrom can be moved in the axial direction of the bowl axis.

8. The decantor type centrifugal separator according to claim 7, characterized in that, the member extending in the direction of the rotating axis from the vicinity of the inner wall of said bowl is a member having a conical inner surface, while the member extending with a specified distance therefrom is a member having a conical outer surface.

* * * * *